US005482208A

United States Patent [19]

Johnston

[11] Patent Number: 5,482,208

[45] Date of Patent: Jan. 9, 1996

[54] ONE-HANDED OPENING DEVICE

[76] Inventor: Brad Johnston, 4027 Brandywine St., Northwest, Washington, D.C. 20016

[21] Appl. No.: 72,101

[22] Filed: May 18, 1993

Related U.S. Application Data

[63] Continuation-in-part of Ser. No. 906,746, Jun. 30, 1992, abandoned.

[51] Int. Cl.[6] ..... B65G 11/04

[52] U.S. Cl. ..... 232/47; 232/45

[58] Field of Search ..... 232/17, 45, 47, 232/35; D99/29

[56] References Cited

U.S. PATENT DOCUMENTS

| | | | |
|---|---|---|---|
| D. 213,738 | 4/1969 | Andis | D99/29 |
| D. 313,104 | 12/1990 | Bertram | D99/29 |
| 830,231 | 9/1906 | Homme | 232/47 |
| 1,086,206 | 2/1914 | Otto | 232/47 |
| 3,801,002 | 4/1974 | Best | 232/17 |
| 3,976,345 | 8/1976 | Walters | 312/333 |
| 4,220,278 | 9/1980 | Hasselbring | 232/35 |
| 4,223,828 | 9/1980 | Whitley et al. | 232/45 |
| 4,724,999 | 2/1988 | Fitzgerald et al. | 232/45 |

*Primary Examiner*—Michael J. Milano

[57] ABSTRACT

A handle for an 1170/K-type United States Postal Service mail collection box which is configured and positioned so as to cause a hand which grasps its end to have enhanced access to the opening of the box, so that the same hand which opens the collection box can also effect a deposit.

5 Claims, 1 Drawing Sheet

ONE-HANDED OPENING DEVICE

This application is a continuation in part of U.S. patent application Ser. No. 07/906,746 filed on Jun. 30, 1992, now abandoned.

FIELD OF INVENTION

The invention relates to devices used for opening hinged deposit receptacles.

SUMMARY OF THE INVENTION

The invention is an improved handle which provides the means for opening USPS mail collection boxes (currently denoted 1170/K) with the same hand which effects a deposit.

The improved handle, which is attached to the face of the closure between the hinge and the hinge-opposed edge, projects away from the outward (ace of the closure for a distance sufficient to clear the overhang of the top of the collection box and then bends back over the top of the box in the general direction of the plane of the closure, terminating beyond the hinge-opposed edge in the hinge-opposed direction and in the general vicinity of said plane.

Because of the configuration and position of the handle relative to the closure the opening, the hand which grasps the terminal portion of the handle is both (a) beyond the hinge-opposes edge of the closure in the hinge-opposed direction and (b) in the general vicinity of the plane of the closure, i.e., forward (relative to where the hand would be when it grasps a staple-shaped handle) in the direction of the opening along the arc formed by the handle as it rotates around the axis of the closure hinge.

Both of the spatial requirements of (a) and (b) above are not met by the staple-shaped handle in current use on the 1170/K-type collection box because that handle puts the opening hand on the UNDER side of the closure door, in a position relatively remote from the opening.

DESCRIPTION OF PRIOR ART

Hinged deposit receptacles are in common use but are opened by devices which (a) move the hand away from the exposed opening and require the second hand to effect a deposit or (b) require gravity or a mechanical device to hold the closure in an open position.

Such receptacles are commonly opened by grasping a staple-shaped handle and pulling the handle and an attached closure away from the opening. The well-known mail collection boxes of the United States Service (USPS) are examples of such receptacles.

U.S. Pat. No. 226,155 (Bauman, 1880) and U.S. Pat. No. 438,573 (Cooley, 1890) disclose opening devices for hinged receptacles but the configuration of the receptacles relative to the opening devices, as well as the hand motion required to effect the opening, makes the devices not germane to applicant's invention.

U.S. Pat. No. 659,486 (Mulloy, 1900) discloses a letter-box which is opened by a device which simultaneously closes an internal holding chamber as the ingress is exposed by the act of opening the letter-box and does not have a "handle" but rather a "projection 9" which is not attached to but instead is integral with the hinge-opposed edge of the closure, in contradistinction to applicant's claims wherein the handle engaging point is specifically stated as being not integral with the hinge-opposed edge of the closure.

Furthermore, the Mulloy "projection" does not cause the opening hand to be beyond the hinge-opposed edge of the closure in the hinge-opposed direction, as required by applicant's claims.

U.S. Pat. No. 1,671,287 (Hoeset, 1928) and U.S. Pat. No. 3,856,036 (Hodge, 1974) disclose opening devices for hinged receptacles but a hand grasping either of the opening devices would be moved to a point relatively remote from the opening and both opening devices require mechanical means to hold the closures in an open position, both in contradistinction to the present invention.

U.S. Pat. No. 3,976,345 (Walters, 1976) describes a depository which is opened by "a means for closing (an) interior chamber to prevent access to objects deposited in (the) interior chamber for safekeeping", citing "a bar lock", "a lock pin", and "a lock enclosure housing" which are utilized in the "securement", none of which structure or purpose relates to applicant's invention. "Handle 78" is a staple-shaped handle which causes the hand engaging the opening device to be moved to a point relatively remote from the opening, diminishing rather than enhancing access to the mouth of the opening by the engaging hand, in contradistinction to the present invention.

Mounted on the opening-remote face of the closure, between the hinge and the hinge-opposed edge, the Walters handle puts the opening hand on the under side of the closure and away from the closure edge.

U.S. Pat. No. 4,220,278 (Hasselbring, 1980) does not comply with the spatial relationships claimed by applicant. The Hasselbring handle, while it projects away from the face of the closure, bends AWAY from the hinge-opposed edge and parallel to the plane of the closure, putting the opening hand on the UNDER side of the closure door in a position relatively remote from the opening, in contradistinction to the present invention.

DESCRIPTION OF THE DRAWINGS

The Figures are preliminary sketches only and depict the upper portion of the familiar 1170/K collection receptacle of the United States Postal Service, showing an improved handle which is the subject of the instant invention.

Figure 1:
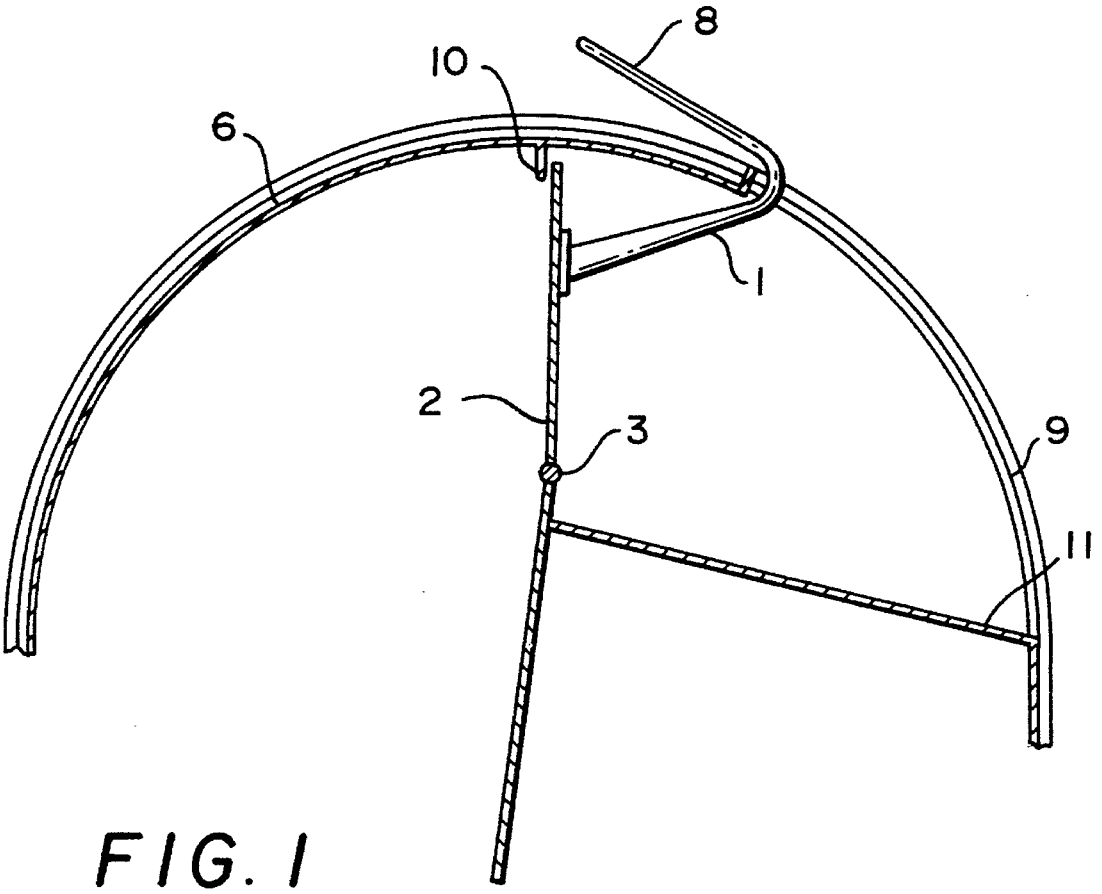
FIG. 1 shows the handle and the closure door to which it is attached in the CLOSED position.
Figure 2:
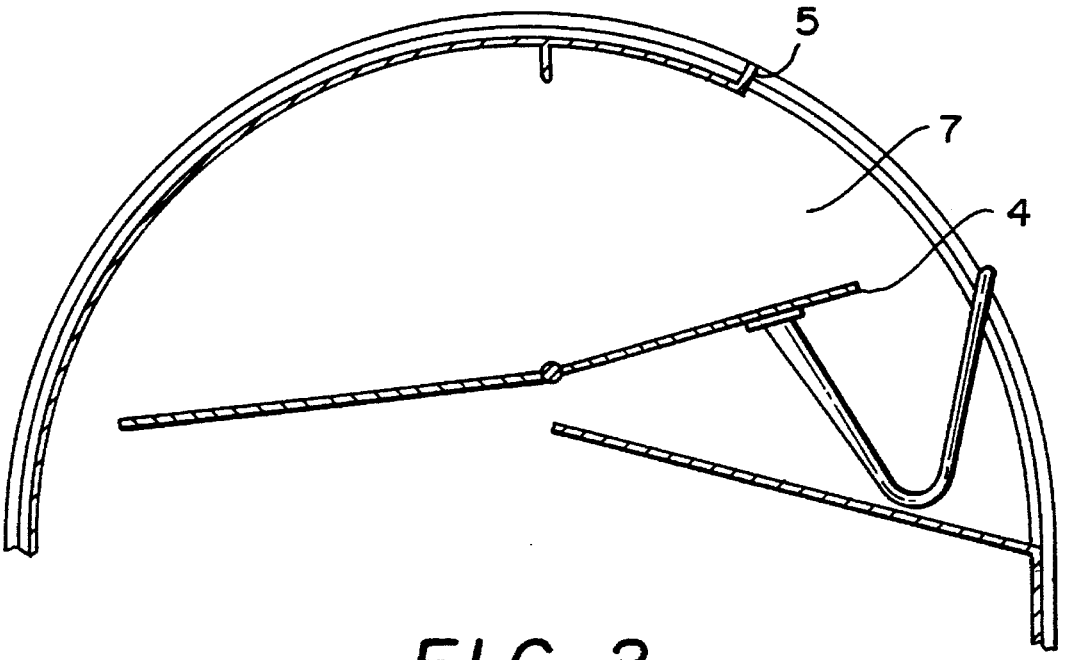
FIG. 2 shows the handle and the closure door to which it is attached in the OPEN position. The enhanced access to the opening when the closure door is in the open position, compared to the access provided by the known staple-shaped handle, is self-evident.

The drawings show the handle (1), the closure door (2) the hinge (3), the hinge-opposed edge (4), the overhang of the box top (5), the top of the box (6), the opening (7), the terminal or end portion of the handle (8), the side of the box (9), the door stop (10), and the front sloping ledge (11).

OBJECTS AND ADVANTAGES OF THE INVENTION

The object of the invention is to overcome the obstacle to the single-handed use of a mail collection box whereby an opening hand is left on the under side of the closure in a position which is relatively remote from the opening, making it difficult or impossible for the same hand to effect a deposit of mail.

The advantage of the invention shown in the Figures is that a hand which moves the end of the opening device and thus gains access to the opening is in an enhanced position relative to the opening and is able to make a deposit of mail without employing either the other hand or a mechanical means to hold the closure door in the open position, as with the cited prior art.

The invention allows a person to hold mail in one hand, open the mailbox with the same hand, and deposit the mail, all the while holding an open umbrella, for example, with the other hand.

The advantage for a handicapped person is self-evident as well as for those having both hands but who are holding umbrellas or packages or children or whatever with the other hand.

The handle has no moving parts and becomes a permanent part of, or attachment to, the hinged closure of the collection box. It can be easily and inexpensively attached at the time of manufacture or easily and inexpensively attached to retrofit existing collection boxes having handles of other types.

Further objects and advantages of the invention will become apparent from a consideration of the drawings and the description which follows. Once the principle is embraced, a person of ordinary skill will be able to make such refinements as widening the opening by moving the door stop forward and shortening the base leg of the handle, for example, or by hinging the point at which the handle attaches to the face of the closure door, if such seems appropriate.

DESCRIPTION OF THE INVENTION

The handle can be configured in many different ways (including as an extension of the closure itself), it can be made of many different materials (e.g., iron, steel, plastic, etc.), it can be manufactured by many different processes (e.g., casting, forging, moulding, etc.), and it can have any cross-sectional configuration (round, square, eliptical, hexagonal, octagonal, etc.), just so long as it maintains the unique aspect of the invention by providing the means for opening the mail collection box with the same hand which effects the deposit, as defined in the Summary on page 2, paragraph 1.

The preferred embodiment contemplated by the inventor is a single, rigid handle of cast malleable iron (using the same material and the same process as the 1170/K handle), to be used as an improved replacement for the staple-shaped handles in use on USPS mail collection boxes and having the same dimensions at the two points where the current handle is now attached, thus facilitating manufacture as well as the retrofitting of collection boxes already in use.

However, the scope of the invention should be determined by the claims and their legal equivalents rather than by the mode cited.

ADDITIONAL APPLICATIONS OF INVENTIVE PRINCIPLE

As disclosed in the parent application #07/906,746, the entire contents of which are incorporated by reference, tie inventive principle also applies to hinged receptacles in general, which are or can be used for deposits or withdrawals.

I claim:

1. A hinged receptacle having a top, an overhang connected to the top, an opening, a closure and a handle attached to the closure, the closure having a hinge edge and a hinge-opposed edge with a hinge connecting the hinge edge to the receptacle, the handle being attached to an outward face of the closure between the hinge and the hinge-opposed edge, projecting away from the outward face of the closure for a distance sufficient to clear the overhang of the top of the receptacle and then bending back over the top of the receptacle in the general direction of the closure, terminating beyond the hinge-opposed edge of the closure in the hinge-opposed direction, a point of attachment of the handle to the closure being the only point of physical engagement between any element or component or part of the handle and any element or component or part of the receptacle, the handle functioning as a means for giving an opening hand which engages the handle enhanced access to the opening and being so configured and positioned relative to the closure as to cause the opening hand to be positioned (a) beyond the hinge-opposed edge of the closure in the hinge-opposed direction and (b) in the general vicinity of the closure.

2. The hinged receptacle of claim 1 wherein the receptacle is of the 1170/K type.

3. A hinged receptacle having a top, an overhang connected to the top, an opening, a closure and a handle attached to the closure, the closure having a hinge edge and a hinge-opposed edge with a hinge connecting the hinge edge to the receptacle, the handle being attached to an outward face of the closure between the hinge and the hinge-opposed edge, projecting away from the outward face of the closure for a distance sufficient to clear the overhang of the top of the receptacle and then bending back over the top of the receptacle in the general direction of the plane of the closure, terminating beyond the hinge-opposed edge of the closure in the hinge-opposed direction, a point of attachment of the handle to the closure being the only necessary point of physical engagement between any element or component or part of the handle and any element or component or part of the receptacle, the handle functioning as a means for giving an opening hand which engages it enhanced access to the the opening as a consequence of the handle being so configured and positioned relative to the closure as to cause the opening hand to be positioned (a) beyond the hinge-opposed edge of the closure in the hinge-opposed direction and (b) in the general vicinity of the plane of the closure.

4. The hinged receptacle of claim 3 wherein the receptacle is of the 1170/K type.

5. A hinge receptacle having an opening, a closure and a handle attached to the closure, said handle projecting away from the outward face of the closure for a distance and then bending back in the general direction of the closure, terminating in the general vicinity of the plane of the closure, the base of the handle being anchored to the outward face of the closure, the point of attachment of the handle to the closure being the only point of physical engagement between any element or component or part of the handle and any element or component or part of the receptacle, the handle being configured and positioned relative to the closure to function as a means for causing the opening hand which engages it to be positioned (a) beyond the hinge-opposed edge of the closure in the hinge-opposed direction and (b) in the general vicinity of the plane of the closure, the point at which the handle is engaged by the opening hand being not attached to nor integral with the hinge-opposed edge of the closure.

* * * * *